United States Patent [19]

Saito et al.

[11] 4,075,534

[45] Feb. 21, 1978

[54] MAGNETRON WITH HOLDING MEANS TO SUPPORT A PAIR OF PERMANENT MAGNETS

[75] Inventors: Hisao Saito; Norio Tashiro, both of Yokohama; Tokuju Koinuma, Kawasaki, all of Japan

[73] Assignee: Tokyo Shibaura Electric Co., Ltd., Kawasaki, Japan

[21] Appl. No.: 717,689

[22] Filed: Aug. 25, 1976

[30] Foreign Application Priority Data

Sept. 1, 1975 Japan ..... 50-104968

[51] Int. Cl.[2] ..... H01J 25/50

[52] U.S. Cl. ..... 315/39.71; 315/39.51; 315/39.75

[58] Field of Search ..... 315/39.51, 39.53, 39.75, 315/39.71, 39.77

[56] References Cited

U.S. PATENT DOCUMENTS

| | | | |
|---|---|---|---|
| 3,465,201 | 9/1969 | Dorgelo | 315/39.71 X |
| 3,746,916 | 7/1973 | Oeuro | 315/39.53 |
| 3,809,950 | 5/1974 | Koinuma | 315/39.71 |

*Primary Examiner*—Saxfield Chatmon, Jr.
*Attorney, Agent, or Firm*—Oblon, Fisher, Spivak, McClelland & Maier

[57] ABSTRACT

In a magnetron of the permanent-magnet-externally disposed-type wherein a pair of permanent magnets are disposed outside an anode cylinder, a yoke magnetically coupling the pair of permanent magnets to each other is extended along the side wall of an anode cylinder of the magnetron, and this anode cylinder is securely fixed to the yoke. The permanent magnets are each supported between the yoke and a seal plate for sealing the opening of the anode cylinder of the magnetron.

10 Claims, 7 Drawing Figures

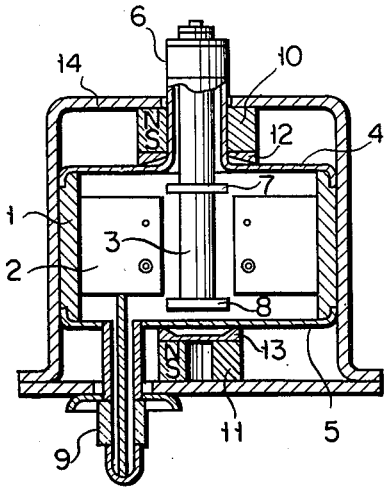
FIG. 1
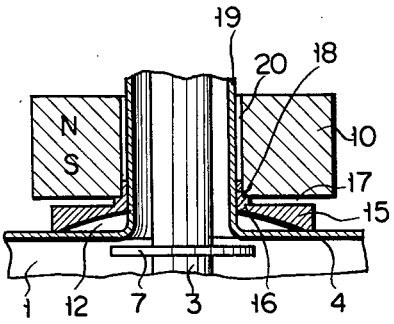
FIG. 2
FIG. 3
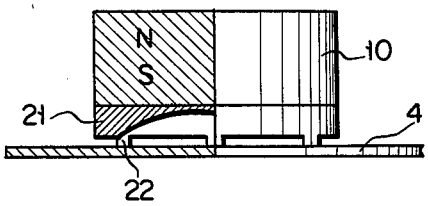
FIG. 4
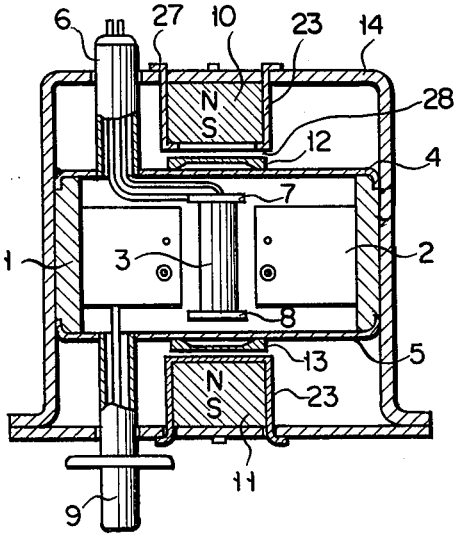
FIG. 5
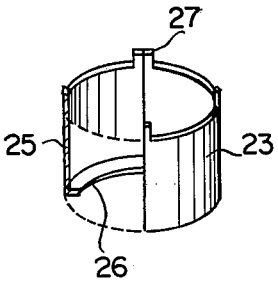

MAGNETRON WITH HOLDING MEANS TO SUPPORT A PAIR OF PERMANENT MAGNETS

BACKGROUND OF THE INVENTION

This invention relates to a magnetron, and more particularly to a magnetron of the permanent magnet-externally disposed type wherein permanent magnets are disposed outside a main magnetron body.

Generally, a magnetron of the type wherein permanent magnets are disposed outside a main magnetron body, in other words outside an anode cylinder, or a so-called permanent-magnet-externally-disposed type magnetron, has the following construction for convenience of its manufacture.

Conventionally, the main magnetron body composed of the anode cylinder formed interiorly with resonance cavities, a cathode member disposed along the central axis of the anode cylinder, and a seal plate hermetically closing the opening of the anode cylinder is not secured to, for example, a frame-work especially by the use of a fixing means but is supported or sandwiched by forces applied thereto, respectively, through the permanent magnets which are disposed at upper and lower parts of the main magnetron body, respectively. These forces are applied through the frame work disposed outside the main magnetron body, whereby the frame work functions as means for holding indirectly the main magnetron body. For this frame work is substituted, for convenience of magnetron manufacture, a yoke magnetically coupling the pair of permanent magnets to each other, thereby to simplify the construction of the magnetron.

The reason for adopting the foregoing construction is to facilitate the assembling of the magnetron during its manufacturing process.

In recent years, however, as material of the permanent magnet of the conventional magnetron a rare earth magnet has come to be used in place of ferrite or the like. As this tendency becomes prominent, it has turned out difficult to adopt the magnetron having the above-mentioned construction for the reasons as later described.

Since the permanent magnet based on the use of a magnet comprising rare earth element-based compounds such as samarium cobalt, cerium cobalt, or the like is possessed of a great coercive force and large energy product, it is possible with a permanent magnet very small in volume to produce a desired magnetic field within the main magnetron body, and this provides an advantage that the magnetron itself can be substantially miniaturized. In spite of this advantage, however, the above-stated rare earth magnet has the drawback of being very low in mechanical strength as compared with an alnico or ferrite magnet usually used as the permanent magnet member of the conventional magnetron. Accordingly, in the case where, in the magnetron of the conventional construction having its main magnetron body sandwiched between a pair of permanent magnets by a frame work, the above-mentioned rare earth magnet is used as those permanent magnets, there is a risk that the permanent magnet is very likely to be damaged. Resultantly, the use of such rare earth magnet has been regarded as undesirable from the standpoint of magnetron manufacture.

In the foregoing description, the damages or breakages of the permanent magnet were explained as the drawbacks peculiar especially to the rare earth magnet.

But where the force applied through the permanent magnet is of extremely large magnitude as a result of the errors made in the magnetron manufacturing process, there is similarly a risk that even a permanent magnet made of ferrite and a main magnetron body having high mechanical strength are easily damaged or broken.

Further, where, as in the conventional case, the magnetron is constructed into the type wherein a main magnetron body is sandwiched through a pair of permanent magnets, the heat generated from an anode cylinder during the operation of the magnetron is easily transferred to the permanent magnetron to produce not only a risk that the magnetic characteristics of the permanent magnet vary but also a disadvantage that difficulties are encountered in using means for preventing heat transfer. Especially in the case of the rare earth permanent magnet, its coercive force decreases with temperature elevation to a greater extent than in the case of the alnico magnet (though to a smaller extent than in the case of the ferrite magnet), thus to necessitate the use of any heat transfer preventing means. Accordingly, the use of the rare earth permanent magnet in the magnetron having the conventional construction is deemed unsuitable.

SUMMARY OF THE INVENTION

Accordingly, it is an object of the invention to provide a magnetron of the structure wherein any undesired force is not applied to the permanent magnet.

It is another object of the invention to provide a magnetron of the structure wherein the heat generated in the main magnetron body is less likely to be transferred to the permanent magnet itself.

It is still another object of the invention to provide a magnetron compact and capable of stably operation for a long time.

According to the invention, there is provided a magnetron comprising a main magnetron body including an anode cylinder formed interiorly with resonance cavities, a cathode member disposed along the central axis of said anode cylinder, and anode cylinder seal means made of non-magnetic material for hermetically sealing openings at both ends of said anode cylinder, antenna means connected to said resonance cavities in said anode cylinder, for radiating a micro-wave generated from said resonance cavities into outside said main magnetron body, a pair of permanent magnets disposed outside the main magnetron body in a manner opposing said anode cylinder seal means to produce a magnetic field in the axial direction of said anode cylinder, a yoke for magnetically mutually coupling said pair of permanent magnets outside said main magnetron body, and main magnetron body holding means mechanically reliably fixed to said main magnetron body, for supporting said pair of permanent magnets.

BRIEF DESCRIPTION OF THE DRAWING

FIG. 1 is a sectional view schematically showing a magnetron according to an embodiment of the invention;

FIG. 2 is a sectional view showing only the permanent magnet magnetic pole pieces and their respective associated sections for the purpose of explaining a modification of the magnetron shown in FIG. 1;

FIG. 3 is a sectional view similar to FIG. 2, showing only the permanent magnet, magnetic pole pieces and their respective associated sections for the purpose of explaining another modification of the magnetron shown in FIG. 1;

FIG. 4 is a sectional view schematically showing the magnetron according to another embodiment of the invention;

FIG. 5 is a perspective view showing a permanent magnetreceiving retainer member used in the magnetron shown in FIG. 4.

DESCRIPTION OF THE PREFERRED EMBODIMENTS

Figure 6:
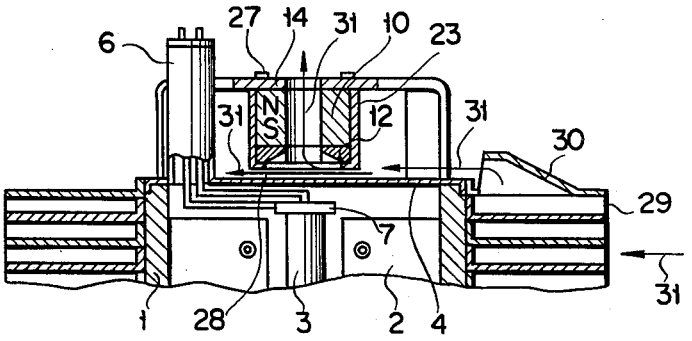
FIGS. 6 and 7 are a partially sectional view and a plan view, respectively, of a modification of the magnetron shown in FIG. 4.

A magnetron according to an embodiment of the invention shown in FIG. 1 comprises a main magnetron body, a magnet device, and a microwave output means.

The main magnetron body includes an anode cylinder 1, a plurality of vanes extending toward a central axis of the anode cylinder 1 from the inner peripheral surface thereof to form resonance cavities within the anode cylinder 1, a cathode member 3 disposed along the central axis of the anode cylinder 1, and a pair of seal plates 4, 5 made of non-magnetic material, for closing the openings at both ends of the anode cylinder 1 to keep the interior of the anode cylinder 1 in vacuum. From the cathode member 3 a cathode stem 6 is extended exteriorly of the anode cylinder 1. This cathode stem 6 is hermetically sealed within a cylindrical section protruded from a central part of one 4 of said paired seal plates 4, 5. Numerals 7, 8 denote end hats provided at both ends of the cathode member 3, respectively.

The microwave output means for radiating outside the main magnetron body the microwaves generated from the resonance cavities between the vanes 2, namely an output antenna 9, is disposed on the other 5 of said paired seal plates 4, 5.

The magnet device is comprised of a pair of rare earth permanent magnets 10, 11, a pair of magnetic pole pieces 12, 13 provided for the pair of permanent magnets 10, 11, and a yoke 14 for magnetically coupling the pair of permanent magnets 10, 11. The magnetron shown in FIG. 1 is a so-called permanent magnet-externally disposed type magnetron in which the pair of permanent magnets 10, 11 are disposed outside the main magnetron body.

In the magnetron of the invention, the main magnetron body, namely the anode cylinder 1 is fixed to a frame body. In this embodiment, the yoke 14 functions as the frame body. More concretely, the yoke 14 for magnetically coupling the pair of permanent magnets 10, 11 is extended along the outer side wall of the anode cylinder 1, and this anode cylinder 1 is secured to the yoke 14 by the bonding means based on the use of adhesive, the forceable insertion or the screwing means. Further, the pair of permanent magnets 10, 11, which are disposed, respectively, on the pair of seal plates 4, 5 so as to produce a magnetic field perpendicular to the electric field produced between the vanes 2 and the cathode 3, are fixed to the yoke 14 so as to achieve a preferred magnetic coupling therebetween. Further, the magnetic pole pieces 12, 13 are fitted to the permanent magnet opposed to the seal plate 5, respectively. In this embodiment, as the rare earth permanent magnets 10, 11 ring-like ones are used, and the cathode stem 6 are inserted into a central hole of said one rare earth permanent magnet 10 and also into a bore formed in the yoke in alignment with this central hole. The magnetic pole pieces have their respective faces opposing the pair of seal plates 4, 5 formed concave as in the case of a magnetron disclosed in U.S. Patent Application Ser. No. 654,532 filed on May 2, 1976 and assigned to the same person as an assignee of this patent application.

According to the magnetron having the foregoing construction, the main magnetron body is independently fixed to the frame body, unlike a conventional magnetron of the structure wherein a main magnetron body is retained by applying thereto a retaining forth through a pair of permanent magnets adopted for convenience of the assembling of the magnetron, and therefore any unnecessary force is not applied to the permanent magnets 10, 11, which enables them to be supported without a risk of being easily damaged. Furthermore, since a force large enough to support the main magnetron body is not applied to the permanent magnets 10, 11 and magnetic pole pieces 12, 13, even the magnetic pole pieces 12, 13 whose faces opposing the seal plates 4, 5 are formed concave can be used easily.

The preceding embodiment referred to the case where the permanent magnets 10, 11 were fixed to the yoke 14. But in this invention the permanent magnets 10, 11 may not be fixed to the yoke 14, and the magnetron may be so constructed that the permanent magnets 10, 11 and magnetic pole pieces 12, 13 are sandwiched between the main magnetron body and the yoke. In the magnetron of such construction, such a force as is able to hold in place the main magnetron body as in the conventional magnetron is not required to be applied directly to the permanent magnets 10, 11, namely the sandwiching force which is very small as compared with the conventional force sufficiently serves the purpose, for this reason there is no risk that the permanent magnets are easily damaged or broken. Besides, in the case where, as shown in FIG. 1, the concave magnetic pole pieces 12, 13 are interposed between the seal plate 4 and the permanent magnet 10 and between the seal plate 5 and the permanent magnet 11, respectively, the seal plates 4, 5 are circular contacted with the concave magnetic pole piece 12, 13, respectively. Therefore, the heat generated from the main magnetron body can be made less likely to be transferred to the permanent magnets 10, 11.

Accordingly, suitable results can be obtained by using as the permanent magnets a rare earth magnet which is low in mechanical strength and apt to be thermally influenced.

Hereinafter, a modification of the above-mentioned embodiment of FIG. 1 will be described. FIG. 2 is a partly sectional view showing only the cathode stem 6 and its associated sections for the purpose of explaining the embodiment of the invention directed to an improvement of the magnetic pole pieces (shown in FIG. 1).

The magnetic pole piece 15 shown in FIG. 2 is provided with a disc-like stepped portion 16 at its substantially central part and the upper face of this stepped portion 16 is arranged to contact the permanent magnet 10. Accordingly, the magnetic pole piece 15 contacts the permanent magnet 10 at said upper face of the stepped portion 16, and a clearance 17 is provided between the magnetic pole piece 15 and the permanent magnet 10. The magnetic pole piece 15 is formed with a cathode stem-insertion bore in a manner that this bore is perforated also through the stepped portion 16. A cylindrical section 18 having an inner diameter equal to that of said bore is integrally provided on the stepped portion 16 in a manner allowed to project from the stepped portion 16. If the permanent magnet 10 is so formed as to permit the inner diameter of the cathode stem-insertion bore to coincide with the outer diameter of the cylindrical section 18, a clearance 20 will be formed, as shown in FIG. 2, between the permanent magnet 10 and an outer seal wall surface 19 for receiving the cathode stem.

According to the modification shown in FIG. 2, the heat generated from the main magnetron body is less likely to be transferred to the permanent magnet 10 owing to the presence of said clearances 17, 20.

According to the invention, even if the magnetron is constructed in a manner provided with the clearances 17, 20 as shown in FIG. 2, a large pushing force is applied neither to the permanent magnet 10 nor to the magnetic pole piece 15 as previously stated, so that there arises no problem such as a damage or breakage of the magnetic pole piece 15.

FIG. 3 similarly shows another modification of the embodiment shown in FIG. 1. A large number of projections 22 are provided on a magnetic pole piece 21 shown in FIG. 3 at the outer edge portion thereof which opposes the seal plate 4. Since the projections 22 of the magnetic pole piece 21 are brought into a substantial point contact with the seal plate 4, a clearance or gap is created between the magnetic pole piece 21 and the seal plate 4. As a result, the permanent magnet 10 is kept thermally isolated from the main magnetron body. The above construction of the magnetic pole piece 21 can with ease be applied to the structure subject to no application of a large pushing force to the permanent magnet 10 and the magnetic pole piece 21.

In FIG. 4, there is shown a magnetron according to another embodiment of the invention. In this embodiment, the permanent magnets 10, 11 are fixed to the yoke 14 by means of a retainer member 23 made of non-magnetic material. This retainer member 23, as shown in FIG. 5, is composed of a cylindrical body 25 adapted to receive therein the permanent magnet 10 or 11, a permanent magnet-supporting ring-like flange 26 attached to a lower opening of the cylindrical body 25, and a plurality of projections 27 provided on the upper opening edge portion of the main body 25. The permanent magnet 10 is received in the body 25 of the retainer member 23 to be supported by the frange 26; and the projections 27 of the retainer member 23 having the permanent magnet 10 received therein are fitted into projections-insertion bores formed in the yoke 14 in corresponding relation to the projections of the retainer member 23; and thereafter the projections 27 protruded externally of the yoke 14 are bent, whereby the permanent magnet 10 is reliably secured to the yoke 14.

The magnetic pole piece 12 is reliably fixed by, for example, adhesive on the seal plate 4 so as to provide a gap 28 between the permanent magnet 10 and the magnetic pole piece 12 itself.

According to the embodiment shown in FIG. 4, as above stated, the gap 28 is provided between the seal plate 4 and the permanent magnet 10. For this reason, the heat transfer from the main magnetron body to the permanent magnet 10 is interrupted. Further, since the retainer member 23 made of non-magnetizable material is used as means for fixing the permanent magnet 10, the retainer member itself concurrently acts as means for protecting the permanent magnet 10 against a mechanical impact or shock applied thereto from outside. This renders the permanent magnet difficult to break or damage. Particularly in this respect, the above construction is suitable to the magnetron using a rare earth magnet as the permanent magnet 10. Further, since the permanent magnet 10 is held in place by the retainer member 23, the permanent magnet 10 and the magnetic pole piece 12 can easily be replaced. Note that measures may be taken for temperature elevation of the permanent magnet by providing heat dissipation fins (not shown) on the outer side face of the retainer member 23 of the permanent magnet.

Figure 7:
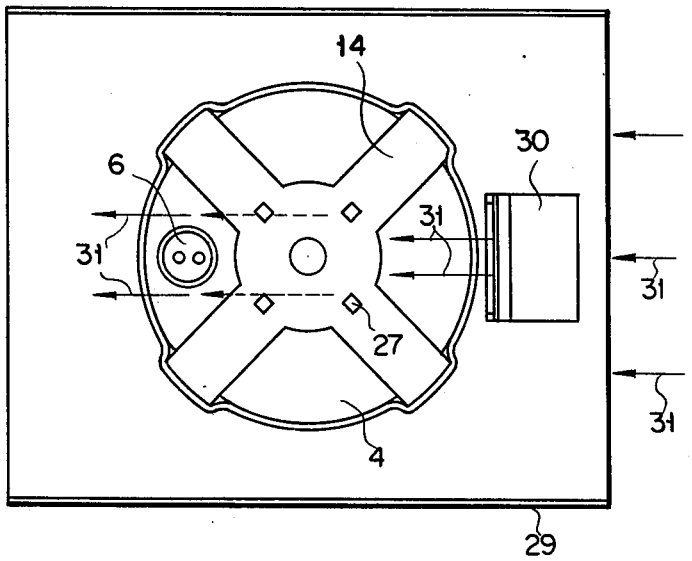

FIGS. 6 and 7 show a modification of the embodiment shown in FIG. 4. The magnetron of FIG. 6 is provided with forced cooling means for interrupting transfer of the heat from the main magnetron body to the permanent magnet 10 through the gap 28. Namely, modification is made of part of air-cooling fins 29 usually provided on the outer periphery of the anode cylinder for the purpose of air-cooling the anode cylinder 1. Namely, a air guide duct 30 is integrally provided on the air-cooling fins 29 so as to permit the air flows introduced through the interspaces therebetween to be directed toward the gap 28. Besides, the yoke 14 to which the anode cylinder 1 is fixed is so disposed as not to interrupt the flow of air from the air guide duct 30, as shown in FIG. 7. Note that the magnetic pole piece 12 is received within the retainer member 23 together with the permanent magnet 10.

According to the magnetron having the cooled air guide duct 30 provided for the air-cooling fins 29, when the flow of cooled air 31 is forcedly sent from outside, it is applied, as shown by illustrated arrows 31, not only to the gap 28 but also to the cathode stem 6, permanent magnet 10 and seal plate 4, thereby cooling these.

As above described, according to the invention, the anode cylinder 1 is reliably fixed to the frame body, which permits the use of a compact rare earth magnet capable of obtaining a desired intensity of magnetic field and yet permits the magnetron to be of the construction wherein the permanent magnet is less likely to be thermally influenced. Thus can be provided a magnetron having compact and stable operational characteristics.

What we claim is:

1. A magnetron comprising a main magnetron body including an anode cylinder formed interiorly with resonance cavities, a cathode member disposed along the central axis of said anode cylinder, and anode cylinder seal means made of non-magnetic material, for hermetically sealing openings at both ends of said anode cylinder, microwave output means connected to said resonance cavities in said anode cylinder, for transmitting microwaves generated from said resonance cavities outside said main magnetron body, a pair of permanent magnets disposed outside the main magnetron body in a manner opposing said anode cylinder seal means to produce a magnetic field in the axial direction of said anode cylinder, a yoke for magnetically mutually coupling said pair of permanent magnets outside said main magnetron body, and main magnetron body holding means mechanically reliably fixed to said main magnetron body, to support said pair of permanent magnets.

2. The magnetron according to claim 1, wherein said yoke for magnetically mutually coupling said pair of permanent magnets is fixed to an outer side face of said main magnetron body and functions also as said main magnetron body holding means for holding in place said main magnetron body and positioning said pair of permanent magnets.

3. The magnetron according to claim 1, wherein said magnetron includes a magnetic pole piece interposed between one of said anode cylinder seal means and said permanent magnet opposing said anode cylinder seal means.

4. The magnetron according to claim 3, wherein said magnetic pole piece and said permanent magnet are securely sandwiched between said anode cylinder seal means and said main magnetron body holding means.

5. The magnetron according to claim 4, wherein said magnetic pole piece has its part contacted with said anode cylinder seal means and a gap is provided therebetween.

6. The magnetron according to claim 4, wherein said magnetic pole piece is provided with a stepped portion and is contacted with said permanent magnet through said stepped portion.

7. The magnetron according to claim 1, wherein at least one of said pair of permanent magnets is retained by a retainer member made of non-magnetic material, for receiving therein said permanent magnet; and by attaching said retainer member to said main magnetron body holding means, said permanent magnet is supported by said main magnetron body holding means to be disposed at a prescribed position opposing said anode cylinder seal means.

8. The magnetron according to claim 7, wherein a gap is provided between said permanent magnet and said anode cylinder seal means.

9. The magnetron according to claim 7, which further comprises a magnetic pole piece interposed between said permanent magnet and said anode cylinder seal means and fixed to said anode cylinder seal means, and a gap is provided between said magnetic pole piece and said permanent magnet.

10. The magnetron according to claim 7, which further comprises a magnetic pole piece interposed between said anode cylinder seal means and said permanent magnet, and said magnetic pole piece is received in and supported by said permanent magnet receiving retainer member together with said permanent magnet, and a gap is provided between said magnetic pole piece and said anode cylinder seal means.

* * * * *